US011173723B2

(12) United States Patent
Schlatterbeck et al.

(10) Patent No.: US 11,173,723 B2
(45) Date of Patent: Nov. 16, 2021

(54) DEVICE AND METHOD FOR PRODUCING A TEXTURED COATING

(71) Applicant: ACTEGA Schmid Rhyner AG, Adliswil-Zürich (CH)

(72) Inventors: Dirk Schlatterbeck, Friltschen (CH); Roland Rüedi, Wädenswil (CH)

(73) Assignee: ACTEGA Schmid Rhyner AG, Adliswil-Zürich (CH)

( * ) Notice: Subject to any disclaimer, the term of this patent is extended or adjusted under 35 U.S.C. 154(b) by 0 days.

(21) Appl. No.: 16/665,720

(22) Filed: Oct. 28, 2019

(65) Prior Publication Data

US 2020/0055082 A1 Feb. 20, 2020

Related U.S. Application Data

(63) Continuation of application No. PCT/EP2018/060534, filed on Apr. 25, 2018.

(30) Foreign Application Priority Data

Apr. 28, 2017 (DE) ..... 10 2017 109 182.3

(51) Int. Cl.
*B05D 3/06* (2006.01)
*B05D 3/04* (2006.01)
(Continued)

(52) U.S. Cl.
CPC ..... *B41J 2/2114* (2013.01); *B05D 3/0466* (2013.01); *B05D 3/067* (2013.01); *B05D 5/02* (2013.01);
(Continued)

(58) Field of Classification Search
CPC ..... B05D 3/0466; B05D 3/067; B05D 5/06
See application file for complete search history.

(56) References Cited

U.S. PATENT DOCUMENTS 5,928,708 A 7/1999 Hansmire et al.
7,556,334 B2 7/2009 White et al.
(Continued)

FOREIGN PATENT DOCUMENTS

DE 10 2006 042 063 A1 3/2008
EP 0 741 370 A1 11/1996
(Continued)

OTHER PUBLICATIONS

Wikipedia. Electromagnetic Spectrum. Dec. 24, 2020. (Year: 2020).*
(Continued)

*Primary Examiner* — Dah-Wei D. Yuan
*Assistant Examiner* — Kristen A Dagenais-Englehart
(74) *Attorney, Agent, or Firm* — Taylor IP, P.C.

(57) ABSTRACT

The present invention relates in particular to a method and a device for a spatially resolved production of a location dependent textured coating. The method includes the steps of provisioning a two-dimensional representation, evaluating a data record of the two-dimensional representation, determining local structures of the two-dimensional representation, determining the type and location of at least one texture that is produced on at least one region of the two-dimensional representation, provisioning a fluid coating material, and applying the fluid coating material to at least one region of the two-dimensional representation.

16 Claims, 2 Drawing Sheets

(51) Int. Cl.

| | |
|---|---|
| ***B05D 5/02*** | (2006.01) |
| ***B05D 5/06*** | (2006.01) |
| ***B41J 2/21*** | (2006.01) |
| ***B41F 23/08*** | (2006.01) |
| ***B41J 2/01*** | (2006.01) |
| ***B41J 11/00*** | (2006.01) |
| ***B41J 3/407*** | (2006.01) |
| *B44F 9/02* | (2006.01) |

(52) U.S. Cl.
CPC ..... *B05D 5/06* (2013.01); *B41F 23/08* (2013.01); *B41J 2/01* (2013.01); *B41J 3/4073* (2013.01); *B41J 11/002* (2013.01); *B44F 9/02* (2013.01)

(56) References Cited

U.S. PATENT DOCUMENTS

| | | | | |
|---|---|---|---|---|
| 10,821,725 | B2 | 11/2020 | Pitz et al. | |
| 2003/0228424 | A1 | 12/2003 | Dove et al. | |
| 2006/0199874 | A1 | 9/2006 | Bhatt | |
| 2008/0158282 | A1* | 7/2008 | du Pau | H05K 3/125 347/20 |
| 2009/0087565 | A1 | 4/2009 | Houjou | |
| 2010/0221449 | A1 | 9/2010 | Schlatterbeck et al. | |
| 2010/0221504 | A1* | 9/2010 | Bauer | B29C 64/112 428/195.1 |
| 2015/0030817 | A1* | 1/2015 | Wiegelmann | B44C 5/04 428/195.1 |
| 2016/0250877 | A1* | 9/2016 | Schlatterbeck | B41J 2/01 428/144 |

FOREIGN PATENT DOCUMENTS

| | | | | |
|---|---|---|---|---|
| EP | 2 178 352 | A2 | 4/2010 | |
| EP | 2178352 | A2 * | 4/2010 | H05K 3/125 |
| EP | 2 418 091 | A1 | 2/2012 | |
| EP | 2 660 067 | A1 | 11/2013 | |
| WO | 02/50374 | A1 | 6/2002 | |
| WO | 2009/012996 | A2 | 1/2009 | |

OTHER PUBLICATIONS

Notification of the Transmission of the International Report and Written Accounts of the International Search Authority or Declaration dated Jul. 9, 2018 for International Application No. PCT/EP2018/060534 (18 pages).

Communication on the Transmission of the International Temporary Report on Patentability dated Jun. 28, 2019 for International Application No. PCT/EP2018/060534 (30 pages).

* cited by examiner

DEVICE AND METHOD FOR PRODUCING A TEXTURED COATING

CROSS REFERENCE TO RELATED APPLICATIONS

This is a continuation of PCT application No. PCT/EP2018/060534, entitled "DEVICE AND METHOD FOR PRODUCING A TEXTURED COATING", filed Apr. 25, 2018, which is incorporated herein by reference.

BACKGROUND OF THE INVENTION

1. Field of the Invention

The present invention relates in general to a method and a device for producing a textured coating. The invention relates in particular to a method and a device for a spatially resolved production of a textured coating.

2. Description of the Related Art

The significance of a three-dimensional design of coated surfaces has increasingly gained importance. It is for example known to produce regions on a coated surface having diverse haptic properties, for example in regard to matt or gloss effects.

Coating layers having a three-dimensional configuration are known for example from European patent EP 0 741 370 B2. A coating layer is described therein into which diffractive structures were introduced which can serve as a security element for forgery proofed documents, such as identity documents. The structures in the coating layer can be maintained for example by way of embossing or molding.

European patent EP 2 178 352 B2 moreover describes a method and a device for accurate application of structures onto a substrate. Here, a structure that is already applied on a substrate is detected in a sensing step and its spatial arrangement is sensed and a coating is subsequently applied in an inkjet printing step, whereby the coating is applied at predetermined locations which are determined depending on the determination of the location of the previously applied structure.

Diverse methods are also known in order to produce the different haptic (tactile) and/or visual properties, for example matt-gloss effects with one and the same coating system.

For example, the method referred to as "chemical embossing" or "drip-off coating" is known wherein a substrate that has been treated regionally differently is covered with a UV coating.

An originally homogeneous coating film can be treated differently in regions by way of a template wherein simply local etching or sand blasting occurs.

Also known is the at least partial creation of roughness in a still fluid coating film with the assistance of high-energy radiation. German patent application DE 10 2006 042 063 A1 describes for example a method for adjustment of the gloss level of surfaces which are obtained through coating with UV or electron-beam-curable coatings. Here, short-wave monochromatic UV irradiation initially acts upon a coating, so that polymerization and cross-linking occur only on its surface layer. In a subsequent step an electromagnetic irradiation acts with another higher wavelength upon the coating layer, so that cross-linking occurs over the entire thickness, and the layer cures. In this manner, a micro-folding is caused in the surface layer which is fixed by the subsequent curing of the entire layer.

In a continued development of this method, European patent application EP 2 418 091 A1 describes a method wherein micro-folding occurs only in sections of the coating surface, whereas a smooth surface is formed in other partial areas of the coating surface. For this purpose the treatment with shortwave irradiation that is necessary for micro-folding occurs only in sections of the coating surface. However, the beam source is designed such—for example with a template or mask—that in other sections of the surface no exposure occurs with the irradiation that is necessary for micro-folding. In this way, surfaces with micro-folded, for example rough surface and non-micro-folded for example smooth and/or high-gloss surface are achieved side by side.

Methods are thus known for introducing surface effects only locally into coatings, for example by micro-folding of surfaces which is only introduced locally.

However, problems exist in determining the regions in which a certain effect is to be produced in order to subsequently produce corresponding textures in a location dependent manner. This is particularly difficult if a two-dimensional visual application comprises many different—in particular also very fine—structures as is the case frequently in photographic images.

What is needed in the art is a method and a device for a spatially resolved textured coating.

SUMMARY OF THE INVENTION

The present invention provides a method and a device to produce a textured coating, in particular to produce a spatially resolved, for example laterally spatially resolved, textured coating, for example a laterally location dependent textured coating. The spatially resolved production of a location dependent textured coating may occur digitally, in other words by way way of ink jet printing.

The method to produce a textured coating, in particular to produce a spatially resolved, for example laterally spatially resolved textured coating, for example to produce a spatially resolved, location dependent, for example laterally location dependent textured coating, includes in particular the following steps:

a. Provision of a two-dimension representation, in particular in the form of an image, wherein the embodiment of the two-dimensional representation is or can be in particular in the form of a photographic image and/or digitized in the form of a data record. The two-dimensional representation may for example be in the form of a printed or written text. It is also possible for the two-dimensional representation to be a graphic representation, for example a drawing or a painting, or that the two-dimensional representation comprises graphic components as well as text components, for example in the form of a photograph with an image signature or in the form of a graphic with signature.

b. Evaluation of the data record of the two-dimensional representation through information-based device, in particular spatially resolved determination of color shade, brightness, saturation, contrast and/or spatial frequency, in particular spatial frequency of the color shade, the saturation, the brightness and/or the contrast.

c. Based on the evaluation of the data record of the two-dimensional representation: defining local structures of the two-dimensional representation. For example, determining of local structures includes recognition of certain patterns and/or characteristics of representations, for example facial features, a water surface, or something similar.

d. Determining the type and location of at least one texture that is to be produced on at least one region of the two-dimensional representation, for example through information-based device. Provided that for example the subject is a two-dimensional representation of a face, the evaluation of the data record has recognized the characteristic features of eyes, eye lashes, eyebrows, lips, etc., and their spatial arrangement on the substrate. Now, the system determines for at least one texture that is to be produced—for example for the iris of the eyes—the type of texture (in this case a glossy surface) as well as its location. It is possible for example to provide eyebrows with the texture of the tiny hairs in order to accentuate them haptically.

e. Provision of a fluid coating material, in particular a lacquer.

f. Applying the fluid coating material to the at least one region of the two-dimensional representation, wherein the coating material is applied in a location-dependent manner, for example in a laterally location dependent manner in such a way that the thickness of the coating and/or the post-treatment of the coating and/or the pre-treatment of the region which is to be coated is specifically adapted to the type of the texture of the coating to be produced in particular to the surface of the coating layer. Provided that for example a texture to be produced represents a high gloss surface which is to be applied onto an image of an iris and provided that another structure represents for example eyebrows—in other words a rough surface image or texture—this different texture can be produced with the same coating materials in that the thickness of the coating is adapted locally. Alternatively or in addition, the type of post treatment of the coating and/or the type of pre-treatment of the region which is to be coated can be varied. In this manner it is even possible to accurately match the representation of the tiny hairs of the eyebrows to the original picture.

According to one embodiment of the invention at least one texture to be produced through information-based device can be changed and/or is changed according to step d. This may mean for example that subsequently a certain texture can be replaced by a second other texture manually or also automatically, for example by way of digital allocation. In place of a smooth glossy texture as is the case for example for snow on a photographic representation of a snow-covered mountain peak it may for example be desirable to produce instead a slightly gritty matt texture or even a texture representing a frost type pattern. It may also be desirable in the representation of a metallic surface to deviate from the visually "glossy" impression which likewise would be consistent with a smooth glossy surface texture, to rather provide the representation with a surface texture that is reminiscent of crystals, consistent for example with the representation of a galvanized surface.

According to one embodiment of the present invention the at least one texture in the at least one region of the two-dimensional representation has a visual and/or haptic impression which differs from the visual and/or haptic impression in another region of the two-dimensional representation. In other words, in accordance with this embodiment of the method the two-dimensional representation has different regions which have different textures. The visual impression of a texture is to be understood to be its visual appearance, in particular as to whether this texture has a matt or rather a glossy appearance. The haptic impression is again the tactile impression of the texture, describing for example its roughness or smoothness.

According to another embodiment of the invention the method also comprises a step for the provision of a substrate whose surface is covered with the two-dimensional representation or into whose surface the visual representation was introduced or is to be introduced, wherein the two-dimensional representation is in the form of a picture file.

According to another embodiment of the invention the method comprises application of the two-dimensional representation onto the surface of the substrate or into the surface of the substrate. This can occur for example if the two-dimensional representation is not available in a tangible form but rather only as a data record.

According to yet another embodiment of the invention the method comprises scanning of the two-dimensional representation, in order to obtain a digital record. This is advantageous for example if the two-dimensional representation is initially not available in the form of a digitized data record, but only in a tangible form. In this case it is for example possible to initially scan the two-dimensional representation in order to create a digitized data record which will subsequently be evaluated in order to subsequently provide fluid coating material which will be applied onto a section of the visual representation in a location dependent manner based on the evaluation of the data record. In addition to color information of the two-dimensional representation, the surface texture and/or the surface relief and/or the height profile of the two-dimensional representation can be recorded and converted into texture information which can be transferred by the coating unit. According to this embodiment of the method it is thus possible to scan a painting having a pronounced height relief (for example an oil painting with heavy application of oil paints), wherein the color as well as the texture and relief information of the two-dimensional representation—in this example in the form of a painting—are recorded by way of a scanner and are digitized. Based on this digitized data record the coating is applied initially by evaluating the color information and a color application based thereon, and then in a further step by evaluating the texture and relief information, so that again the optical and haptic impression of an original oil painting is created. With the method it is thus possible to produce not only a texture, but also a surface relief of a coating on a two-dimensional representation.

It is thus possible, that the structure is applied consistent with the image information provided by the original image and possibly generated in-line. This in-line creation of an image information includes for example that the image information occurs for example through scanning of a template or an original. It is however also possible to provide this image information in that a digital file, for example comprising spatially resolved and/or location dependent color information of a two-dimensional representation is provided, and alternatively or in addition thereto information in regard to surface relief. In addition it is also possible, that on the basis of scanning of an original and chronologically, following scanning by way of evaluating of this original through informative means, texture information is first generated in such a manner that based on the evaluation of the original a suitable texture information is selected. This can happen through a suitable evaluation program but can also be selected through operator intervention or—after a preselection by the information device, for example by way of an evaluation program stored on a computer—can be changed by an operator.

Scanning can for example also be implemented by a scanner which in addition to the pure image information also records the height profile of the original so that a 3D-information of for example the texture of a surface can also be directly captured. In this manner, a digital printer can not only create an image, but according to one embodiment of the invention also the additional design, in particular of the texture of a surface.

A scanner can for example be provided by a Cruse Scanner supplied by Cruse Spezialmaschinen GmbH.

If a plurality of same two-dimensional representations which are present for example in a tangible form, for example in the embodiment of printed sheets are successively covered with a fluid coating material in a spatially resolved manner, so that in at least one region of the two-dimensional representation a textured coating is achieved in a location dependent manner, scanning can be implemented for example for the first of this plurality of same two-dimensional representations. Application of the fluid coating material and texturing of the coating of the subsequent two-dimensional representations occurs then accordingly based on the evaluation of the data record which was obtained through the scan of the first two-dimensional representation.

Scanning occurs in accordance with one embodiment of the invention with a sensor, in particular a color sensor, in particular comprising a UV laser diode. A color sensor of this type generally includes a light source, in particular a broadband light source which emits in particular in the region of the visible light. Conventional color sensors are able to recognize colors and color differences in the visible spectral range, that is in the range of 200 nm to 800 nm, and to produce colorimetric measures. A detection occurs in particular in a spatially resolved manner. Conventional color sensors operate in a three-color space, so that for example color data for an image point or pixel is obtained in the form of a so-called RGB value. According to an additional embodiment of the invention, in order to provide compatibility of such RGB values with other color values, for example L*a*b*-values of the CIEL*a*b* system or other color systems, a conversion of the determined color values occurs from one color system—for example a color system from a three-color space—into another color system.

According to one embodiment of the present invention, the determination of a pixel size occurs during the scanning process. This pixel size determines the resolution and evaluation of the image data and is retained or possibly even improved for the production of a texture produced in a location dependent manner. This pixel size is used in particular for the application of a fluid coating material and/or is retained or improved in the location dependent, preferably laterally location dependent creation of a texture in the coating, for example the finish. The resolution is between 600 dpi to 1200 dpi. The drops of the coating may be applied by way of ink-jet have droplet volumes of several 10 pl down to 3 pl (Pico liter) possibly even less. The droplets having 3 pl volume have a diameter of 18 μm. The droplet volume correlates with the diameter (to the third power). At a droplet volume of 6 pl, a diameter of 23 μm is already achieved. For propagation of the droplets on the substrate, the substrate itself plays a certain role, so that the droplet diameters on the substrate can certainly turn out to be different. In these resolutions the distances of the produced drops are the minimum nozzle distances. This corresponds with approximately 45 μm at 600 dpi or 23 μm at 1200 dpi. It is expected that with further development, even smaller diameters can be achieved, wherein a droplet volume of 0.1 pl can be assumed to be the lower limit.

The special impact of the coating for the production of a spatially resolved and location dependent texture moreover may also be that due to the refractive index of the coating which can be assumed for conventional coatings to be between 1.47 and 1.6, possibly even a microlens type effect of the coating can be achieved, thereby being able to increase the visibility of special structures in the two-dimensional representation according to the method.

Particular mention should be made of scanners which, in addition to the color information of the image also capture a relief information whereby relief information herein is considered to be the three-dimensional height profile, in other words the progression of the height lines of the coating application on the two-dimensional representation. This is captured for example as an additional gray scale image. In this manner textures which can for example be in the form of a woven fabric or a corrugated sheet can be detected. It is moreover possible with this scanner to scan a painting which is painted in oil and to capture the brush stroke of the artist, in other words the thickness of the color layer in addition to the color information. In the latter example, a color print could be produced onto which additional to the color the brush stroke was imprinted with the aid of a colorless coating with laterally different layer thickness analogous to the gray scale image of the height profile. In this manner, digital reproductions of original paintings can be produced. Other applications would include for example the production of woven fabric patterns in catalogues where for example cushion covers need to be realistically portrayed.

Scanning can for example also be conducted by a scanner which, in addition to the image information also captures the height profile of an original, so that a 3D information of for example the texture of an original can be directly captured. In this manner not only a picture can be produced with the digital printer (in other words a printer working according to the ink jet method), but according to one embodiment of the method also the additional arrangement, in particular the texture of a surface.

A scanner can for example be provided by a Cruse Scanner of the Cruse Spezialmaschinen company.

The creation of the texture occurs according to embodiments of the method and also by way of a location dependent, preferably laterally location dependent preset thickness of the coating and/or by way of a location dependent, for example a laterally location dependent implemented pretreatment of the surface to be coated and/or by way of a location dependent, for example a laterally location dependent post treatment of the produced coating or respectively the produced coating film, for example a lacquer or a lacquer film.

According to a further embodiment of the invention the fluid coating material comprises a coating, for example a radically curing coating, for example a UV curing coating, wherein the coating is designed in such a way that the reactivity on the surface of the applied coating film specifically differs from the reactivity in the volume of the applied coating film.

In accordance with yet another embodiment of the invention, the method comprises a curing step of the applied fluid coating material. Curing may occur in a location dependent manner. In particular the duration of curing and/or the type of curing in different regions of the applied coating and/or between coating applied in different partial regions of the two-dimensional representation is always adapted to the type of the texture to be produced. In this way it is possible to always produce a location dependent texture in different sections that is adapted to the relevant structure of the two-dimensional representation. If for example the two-dimensional representation is in the form of a photograph of a wintery house, it is for example possible to produce a coating on the window surfaces of the house and to produce a frost type effect in a partial section of the image of the widows which feature a frost type effect, whereas areas of a window not covered with ice give a high gloss impression. In this case it is for example possible that the fluid coating material has the same thickness across the entire surface of the representation of the windows, that however curing varied in different areas. It is however also possible that a different thickness of the coating film is produced in a spatially resolved manner and that curing occurs subsequently in both areas in the same manner, but also differently.

In accordance with one embodiment of the method, irradiation of the coating occurs in the same way across the entire surface, whereby in the different regions a different microfold results, depending on the spatially resolved and/or location dependent different layer thickness of the coating. It is also possible that one region has no microfold.

In another embodiment only the layer thickness is varied, and curing occurs across the entire surface of the two-dimensional representation in such a way that the same power is introduced into the coating. For example, curing may occur over the entire surface of the two-dimensional representation by way of a mercury medium pressure emitter. In this case it is possible that the curing takes place differently only depending on a location dependent, for example laterally location dependent, different thickness of the coating, wherein for example in one region with a greater layer thickness of for example 12 μm and higher, micro-folding occurs, whereas in a region with a lesser layer thickness of for example less than 10 μm no micro-folding at all occurs. In other words, a different surface texture can be achieved, simply as a result of the laterally different layer thickness but with otherwise the same post treatment and in particular the same curing of the coating.

According to this embodiment, the thickness of the applied coating material is different spatially resolved, for example laterally spatially resolved and curing occurs in such a way that across the entire surface of the two-dimensional representation the same power is introduced into the coating, for example by way of a mercury medium pressure emitter.

To irradiate the coating, according to one embodiment of the invention UV-C irradiation with a wavelength of 240 mm and more is introduced into at least one region to be textured in the surface layer of the coating.

In accordance with another embodiment of the method, the irradiation occurs in a location dependent two-step manner in that, in one section of the fluid coating material that was applied onto at least one region of the two-dimensional representation a smaller UV dose which produces micro-folding is administered in a first step. In a second step, the layer in the section of the fluid coating material is completely cured, wherein longer wave UV irradiation is used than that of a UV medium pressure emitter, so that in the irradiated section of the coating a predefined texture of the surface of the coating is obtained which deviates or can deviate from the texture or the textures of the surface in other sections of the coating or in other sections of the coating applied to the two-dimensional representation. "Longer wave UV irradiation" refers to the fact that hitherto in particular Excimer irradiation is used for micro-folding which—compared to the herein referred to irradiation of a UV medium pressure emitter—is shorter wave.

According to yet another embodiment of the present invention, micro-folding as well as complete curing is achieved in one irradiation step. Here, the coating material is arranged so that the absorption of UV irradiation varies across the layer thickness of the applied layer of fluid coating material.

According to yet another embodiment of the present invention, irradiation of the surface layer and irradiation for the purpose curing of the coating occurs in each case by way of a mercury medium pressure emitter.

The location dependent irradiation of the surface layer for micro-folding may occur in at least one section by way of spatially resolved scanning of the coating surface.

One embodiment of the method may include screening by scanning the surface line by line, and the line is moreover divided into individual image points or pixels and each line respectively is assigned to a forward move of the scanner head. The pixel size can correspond with the size of the pixel which was detected during the scanning process of the two-dimensional representation or is even improved compared to same. The scanner head thus has a greater resolution for location dependent irradiation than the scanner head of the color sensor.

According to another embodiment of the present invention, irradiation occurs by way of UV irradiation in an inert gas atmosphere, for example a nitrogen atmosphere.

According to another embodiment of the present invention, the residual oxygen content is less than 5000 ppm, preferably less than 1000 ppm and especially preferably less than 500 ppm.

According to another embodiment of the present invention, the application of the fluid coating material occurs by way of a printing process, in particular gravure printing, flexo printing, screen printing, pad printing or inkjet printing. The coating may be applied by way of inkjet technology. With this method it is especially easy to produce different layer thicknesses of the coating material in different regions on the surface in one pass.

An additional aspect of the invention relates to the provision of a device to produce a textured coating, in particular for a spatially resolved, for example laterally spatially resolved production of a textured coating, for example a spatially resolved production of a location dependent, for example laterally location dependent textured coating, including:

a. a device to accommodate the substrate
b. a device to transport the substrate between the individual workstations
c. a device to scan a two-dimensional representation, in particular in the form of a color sensor, preferably in the form of a color sensor which comprises a UV laser diode, wherein the device senses spatially resolved parameters of the two-dimensional representation, so that a digitized data record is obtained, and a device to sense a height profile of a two-dimensional representation, for example an acrylic or oil painting,
d. an information device to store and/or evaluate a digitized data record of a two-dimensional representation, for example in the form of a computer, wherein the data record includes color information as well as the height profile of the two-dimensional representation, wherein the height profile can be in particular in the embodiment of a gray scale image, e. a device for applying the fluid coating material onto a substrate, wherein the device can be designed in such a way that the fluid coating material is applied over the entire area of the surface of the substrate or only over a section of the same, f. a device for curing the coating, wherein curing takes place in a location dependent manner, for example laterally location dependent, in particular in two steps and the energy introduced by the device into the coating in a location dependent, for example laterally location dependent manner is adjustable in such a way that in a first step only the surface layer of the coating is treated in a location dependent, for example laterally location dependent manner, wherein the surface layer has a thickness of between 10 nm and 1 μm; and wherein, in a second step the coating is curable over the entire thickness in a location dependent, for example laterally location dependent manner, g. a removal device for removal of the substrate, and h. a system control unit, for example in the form of information device, for example a computer, for controlling the process steps of the device by controlling the parameters of all process steps and ensuring their interaction.

The device for curing according to point f. can however also be designed such, that curing occurs in a single step. In this case curing of the coating can occur differently in a location dependent manner, if the coating has in particular a varying layer thickness in a location dependent ad/or spatially resolved manner. It is also possible that the device comprises two UV emitters for curing, wherein the UV emitters, emit different wave lengths, so that curing occurs in a two step manner, whereby only one or the other emitter is used as required.

The system control unit also includes ways to read out parameters in an informational format which is generally used in the printing industry, for example JDF (Job Definition Format) and to convert the parameters into process steps. Such means can for example include a parameterization file.

According to another embodiment of the invention the device includes at least always one sensor as well as one encoder and actuators in order to detect the respective process steps and control them through the computer by way of corresponding actuators.

According to yet another embodiment the device includes a provision for digital processing with embossing film. Here, an adhesive is digitally spatially resolved, for example laterally spatially resolved, and is possibly applied also with different layer thicknesses onto the substrate or onto an embossing film, and the embossing film is subsequently partially transferred. The embossing film is for example a PET carrier film with a multilayer coating, wherein one layer includes aluminum metallization which, due to a colored layer can also be gold colored after the transfer or which can comprise other metallic effects. Other effects, such as holograms or other interference structures can also be transferred.

The device can moreover be in the embodiment of a compact unit which can for example be used in home applications or in a copy shop.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
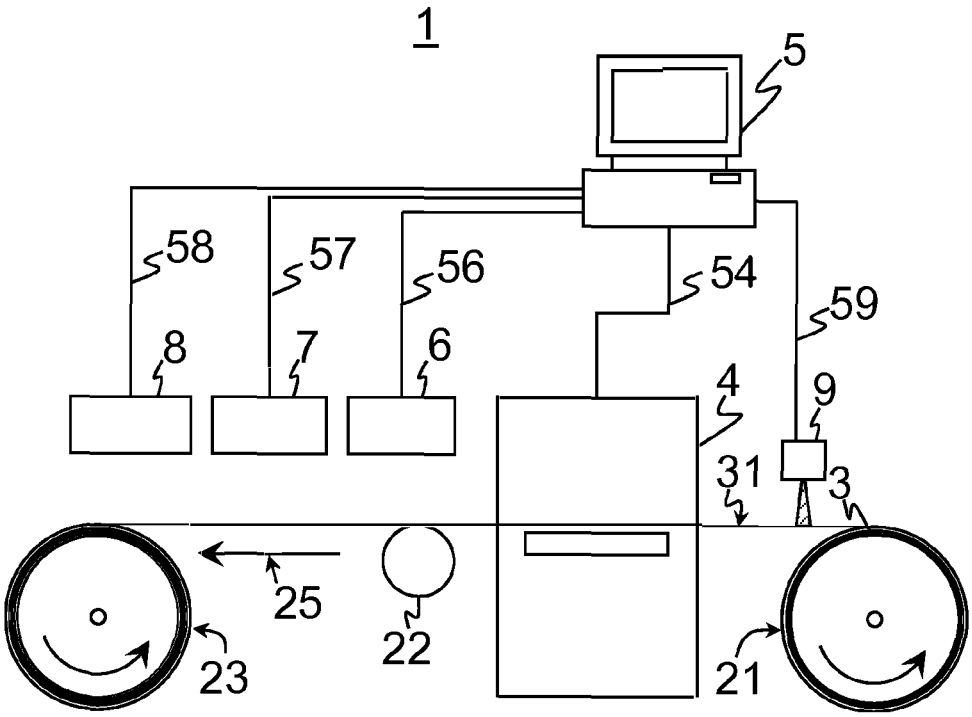
FIG. 1 is a schematic illustration of one embodiment of a device for producing a textured coating on a substrate.

Within the scope of the current invention the following definitions apply:

Coating: within the scope of the current invention, coating is understood to be a fluid, for example liquid or highly viscous coating material, by way of which a layer is applied onto a substrate. A thus obtained layer, which is referred to as a coating layer but also as coating, serves as a rule to protect the surface, for example to improve scratch resistance and for finishing, for example by producing a certain surface impression such as a high gloss surface.

Texture: the texture describes generally the character of a surface, in particular in regard to its optical and/or aesthetic properties, wherein however the color is not considered. Of special interest are those properties of a surface which determine the gloss thereof, in other words the measure of reflecting or controlling light impinging onto the surface, as well as the properties which influence the haptic properties, in other words properties that influence contact with the surface. In this case, the relief of the surface (also referred to as surface relief), in other words the progression of the height lines and the roughness of the surface are of importance. Within the scope of the current invention, the relief of the surface of a two-dimensional representation is also referred to as the height profile thereof.

Image: within the scope of the current application, an image is understood to be a two-dimensional representation, for example in the form of a photograph or a drawing, but also in the form of text. The image may moreover also be a painting, in particular an oil and/or an acrylic painting. Such paintings are characterized in particular by heavy paint application fluctuating locally, which is attributed to the brush strokes during paint application and which thus have a pronounced surface relief.

Structure: within the scope of the current application, a structure is understood to be the visual character of a region of a two-dimensional representation, which specifically differentiates from the visual character of other adjacent regions. For example, a structure can be available in the form of a pattern, in other words as a visual design of a surface which has a certain symmetry and/or periodicity. It is however also possible that the visual representation forming the structure is random in the sense that it only has a certain near-order, for example like a visual representation of a bark of a tree or in the form of a non-periodic but organized arrangement. In the sense of the current invention, a structure is also understood to be such regions which, according to life experience of other regions, are clearly perceived differently. For example, in visual representations of a face different structures can be distinguished. For example, in regard to eyes the region of the iris can normally be distinguished as a round or respectively rounded region and the lashes as dark, oblong curved thin regions.

Spatially resolved application: spatially resolved application of a substance, for example of a coating material onto a surface is generally understood that the application occurs onto previously defined regions of a substrate—for example paper or cardboard—to be coated. The spatially resolved application of printing ink for example includes the creation of an image and/or printed text.

Location dependent application: if, hereinafter reference is made to a location dependent application, this refers generally to spatially resolved application and/or post treatment of a coating material, for example a coating in such a way that the application—depending on the location where the application of the coating material occurs, occurs with location specific differences. Conducting a location dependent application, or the location dependent application implies for example that a coating material is applied onto a substrate that is to be coated at a certain thickness which can differ from the thickness with which the coating material is applied in another region of the substrate.

It is however also possible that the same coating material is applied in a location dependent manner with the same thickness in different regions, but that a different location dependent post treatment of these regions occurs.

Naturally, it is also possible that with a location dependent application the type of the material that is to be applied and/or the thickness of the layer that is to be applied and/or the post treatment of the layer that is to be applied is implemented differently, According to one embodiment it is thus possible to combine the application of different layer thicknesses with different post treatments. Micro-folding or self-matting of a coating is dependent on the layer thickness and can—as discussed—result in matt or glossy regions.

Haptically, they differ from each other in an extreme manner. The glossy locations are rather "sticky", so that when passing over them with the finger, the finger is inhibited, whereas in the micro-folded regions the finger glides easily and the film feels "soft".

Provided that a laterally location dependent and/or spatially resolved application is discussed within the scope of the current invention it is to be understood that the application of the coating differs—in particular in regard to the laterally applied coating, in other words the coating and/or ink applied across the width—in a location dependent and/or spatially resolved manner Printing inks: fluid coating materials whose function is essentially the visual design of substrates which are to be covered or coated, for example in the creation of images or of text are generally referred to as printing inks or inks. Printing inks are thus designed in particular as coloring substances, for example through the addition of pigments and/or coloring agents into the fluid coating material. The term "printing ink" and "ink" are normally used synonymously.

Three-dimensional design of surfaces: a-three-dimensional design of a surface is understood to be an arrangement when a coating material for producing a coating is defined not only as two-dimensional in the manner that for example an image and/or a text is obtained, but when the application of the coating material—for example a lacquer—occurs in such a manner that also the height of the application of the coating material, for example of a lacquer layer and/or the height progression in this coating, for example the relief thereof is designed, for example by way of targeted spatially resolved, preferably laterally spatially resolved adjustment of a certain thickness of the material application and/or of a selected also spatially resolved, for example laterally spatially resolved manner of post treatment of the coating material and/or of a selected laterally different composition of the coating material.

Coating: within the scope of the current invention, coating is understood to be the process of coating, in other words the production of a surface layer on a substrate. In coating, a material layer is deposited onto a surface, whereby normally a connection between the coating material and the substrate is formed, so that a bond is present between the created layer and the substrate. This is possible for example by forming an interface layer between layer and substrate, for example in that a primer or adhesive is applied to the parts of the substrate to be covered or coated prior to application of the coating material. It is also possible that a fluid coating material migrates at least into parts in surface-near regions of the substrate to be covered and that an adhesive bond is formed in this manner. The layer of coating material on a surface has a certain height, which may for example be in the range of several micrometer in coatings.

In contrast to such coating are methods in which the applied material is absorbed by the substrate, so that no, or only a very small local elevation results. This is the case for example when an ink is applied onto an absorbent substrate. In this case, the ink is absorbed by the material, for example paper, so that in this case not so much as an application occurs on the surface of a substrate, but rather an input of material into the surface of the substrate. The definition of the "coating" comprises in particular also the definition of coating, where the coating is a layer which is created by applying a lacquer as a fluid coating material onto a surface of a substrate.

Color: the color of a two-dimensional representation is understood to be the impression of color or color location thereof. The color impression or color location can be stated in a number of ways, in particular in different so-called color spaces or color systems. As a general rule, color sensors operate for example in a three-color space.

Micro-folding: in the context of the current invention, the term "micro-folding" is understood to be the following phenomenon: In a first step the surface layer of an applied fluid coating material is cured to a membranous layer, in other words to a layer which is harder or tougher near its surface. Due to shrinking that occurs during curing on certain materials, for example unsaturated acrylates as are contained for example in radically UV curable formulations, this surface layer shrinks during curing. This causes a structure which determines that at least in one section of the coating surface a local change in the coating thickness occurs, so that the thickness fluctuations are at least in a single digit micrometer range. The surface layer can in particular be folded. The applied fluid coating material is cured over the entire volume in a second step.

EXAMPLES

The method according to embodiments of the current invention can be implemented for example especially effectively by way of fluid coating materials which can be cured by energy particle radiation, in particular UV irradiation, in particular radical polymerization and which is open to a micro-folding process. Micro-folding occurs through irradiation of the surface layer of an applied coating, for example through irradiation with UV-C irradiation with a wavelength of more than 240 nm.

A fluid coating material (or coating fluid) suitable for implementation of the method according to embodiments of the invention can generally consist of a composition wherein 100 parts of a liquid binding agent are applied to 13 parts of a mixture of photo initiators and/or cross-linking agents and/or activation agents for curing.

Within the scope of the current invention, photo initiators are understood to be substances which are activated by absorption of light, in particular UV light and subsequently form a reactive species, in particular radicals or cations. The formation of reactive species occurs either due to breakdown of the molecule and/or through interaction with a synergist.

According to one embodiment of the invention, photo initiators are used which form radicals.

Within the scope of the current invention, cross-link agents and/or activation agents are understood to be substances which cause polymerization reactions to be especially efficient, for example in that they are suitable to form especially effective initiator radicals. Another example for an increase in efficiency is the transfer of a radical that is inactive due to oxygen inhibition into a renewed initiator radical. Within the framework of this disclosure, the activation agent is always also a synergist and can be referred to as such.

According to one embodiment of the present invention, a tertiary amine is used as a cross-link agent or respectively an activation agent. This may occur according to another embodiment of the invention when a so-called type II-photo initiator is used as a photo initiator. In the case of a type II-photo initiator radicals are formed in that the activated photo initiator—for example benzophenone in the triplet state—removes a hydrogen atom from an adjacent molecule. In contrast, in the case of Type I-photo initiators the radicals form directly due to the breakdown of the initiator molecule. An example of a Type I-photo initiator is available under the trade name "Irgacure 173" or "Darocur 1173" and comprises 1-phenyl-2-hydroxy-2-methyl-1-propanone.

A binding agent on an acrylate base is preferably used.

It is also preferred if the mixture of photo initiators and/or cross-linking agents and/or activation agents consists of one part of a photo initiator of Type I, 6 parts of a photo initiator Type II and 6 parts of an activator agent.

The synergist (or also activating agent), together with type II photo initiators always causes the oxygen inhibition to be overcome and is used in particular in cross-linking under atmospheric conditions in order to enable and/or enhance a surface reactivity.

According to one embodiment of the invention, the liquid coating material is composed of the following:

40 parts HDDA (hexanediol diacrylate)
10 parts TMPTA (trimethylolpropane triacrylate)
50 parts DPGDA (dipropylene glycol diacrylate)
1 part Irgacue 1173 (or Darocur 1173)
6 parts benzophenone
6 parts N-methyl diethanolamine.

So that a targeted difference between the reactivity on the surface of the applied coating film and the reactivity in the volume of the applied coating film is achieved in that 1 part of a photo initiator of Type I, in this case 1-phenyl-2-hydroxy-2-methyl-1-propanone, 6 parts of a photo initiator of Type II, in this case benzophenone, and 6 parts of an activating agent, in this case N-methyl diethanolamine are used for 100 parts of a liquid binding agent mixture (in this case comprising HDDA, TMPTA and DPGDA). By changing the shares of photo initiators Type I relative to the shares of the photo initiator Type II additional targeted differences can be achieved between the reactivity on the surface of the applied coating film and the reactivity in the volume of the applied coating film.

Within the scope of this disclosure, the term "share" relates to weight shares.

According to an additional embodiment of the invention, the liquid coating material is composed of the following:

80 parts HDDA (hexanediol diacrylate)
20 parts TMPTA (trimethylolpropane triacrylate)
1 part Irgacue 1173 (or Darocur 1173)
6 parts benzophenone
6 parts N-methyl diethanolamine.

So that a targeted difference between the reactivity on the surface of the applied coating film and the reactivity in the volume of the applied coating film is achieved, 1 part of a photo initiator Type 1, in this case in this case 1-phenyl-2-hydroxy-2-methyl-1-propanone, 6 parts of a photo initiator of Type II, in this case benzophenone, and 6 parts of an activating agent, in this case N-methyl diethanolamine are used for 100 parts of a liquid binding agent mixture (in this case comprising HDDA and TMPTA) and in contrast to the previous example a binding agent mixture is used that has greater reactivity. By changing the shares of the photo initiator of Type I relative to the shares of photo initiator Type II additional targeted differences can be achieved between the reactivity on the surface of the applied coating film and the reactivity in the volume of the applied coating film.

An additional example of one product which can be provided with a microfold by way of irradiation by a mercury medium pressure emitter can be coated with the following formulation:

100 parts DPGDA (dipropylene glycol diacrylate)
1 part Irgacue 1173 (or Darocur 1173)
6 parts benzophenone
6 parts N-methyl diethanolamine.

So that a targeted difference between the reactivity on the surface of the applied coating film and the reactivity in the volume of the applied coating film is achieved, 1 part of a photo initiator Type 1, in this case in this case 1-phenyl-2-hydroxy-2-methyl-1-propanone, 6 parts of a photo initiator of Type II, in this case benzophenone, and 6 parts of an activating agent, in this case N-methyl diethanolamine are used for 100 parts of a liquid binding agent mixture (in this case comprising DPGDA). The utilized DPGDA as difunctional binding agent forms a relatively soft film. The volume shrinkage is less pronounced compared to TMPTA-containing formulations. By changing the shares of photo initiator of Type I relative to the shares of the photo initiator Type II additional targeted differences can be achieved between the reactivity on the surface of the applied coating film and the reactivity in the volume of the applied coating film.

In an additional embodiment the microfold is achieved in a single hardening step. For this purpose, elastic aliphatic urethane acrylates must for example be added to the coating formulation. Very good reactivity is achieved, while simultaneously achieving a pronounced effect with the following formulation:

80 parts DPGDA (dipropylene glycol diacrylate)
20 parts Ebecryl 4491 by Allnex
1 part Irgacue 1173 (or Darocur 1173)
6 parts benzophenone
6 parts N-methyl diethanolamine So that a targeted difference between the reactivity on the surface of the applied coating film and the reactivity in the volume of the applied coating film is achieved, 1 part of a photo initiator Type 1, in this case in this case 1-phenyl-2-hydroxy-2-methyl-1-propanone, 6 parts of a photo initiator of Type II, in this case benzophenone, and 6 parts of am activating agent, in this case N-methyl diethanolamine are used for 100 parts of a liquid binding agent mixture (in this case comprising DPGDA and Ebecryl 4491). By changing the shares of the photo initiator of Type I relative to the shares of the photo initiator Type II additional targeted differences can be achieved between the reactivity on the surface of the applied coating film and the reactivity in the volume of the applied coating film.

Similar effects can also be achieved with AC resin 250 by BASF.

All aforementioned formations are base formulations which, in order to achieve processability can be further enhanced by the addition of appropriate flow additives and wetting additives. These additions, however, have no influence over attainment of the desired effects. Furthermore, to achieve micro-folding in these examples, a layer thickness of at least 12 μm is necessary. In a range of between 10 and 12 μm micro-folding is formed unevenly. Below 10 μm the surface always remains glossy. Through a targeted influence over the formulation and the curing conditions (wavelength, dose, intensity) the layer thickness range in which micro-folding is achieved can be adjusted in a wide range. Micro-folding can even be completely prevented by way of accordingly high doses of a suitable wavelength (UV-C).

The aforementioned formulations are characterized by a very low processing viscosity (70-120 s in the DIN 2 flow cup) which permits their utilization in inkjet printer heads. A method can herein be utilized which permits simultaneous production of regions having very different layer thicknesses.

The effect of micro-folding is however in no way dependent upon the viscosity. It is also possible to produce formulations having much higher viscosity which can be applied with other methods. It is important to achieve a relatively higher reactivity on the surface than in the volume. The utilized photo initiators must herein demonstrate their absorption maximum in the UV-C-range.

The effect of micro-folding can be prevented if higher concentrations of photo initiators are added to the formulation for volume curing (for example>2% Irgacure 1173 at an otherwise same concentration of photo initiators in the formulation can prevent the effect). The same applies if photo initiators having a higher absorption wavelength are used in suitable concentrations for volume curing. Thus, micro-folding can be prevented by addition of 1% TPO (triphenylphosphine oxide) into the aforementioned formulation. The stated percentages refer to weight percent.

FIG. 1 shows a schematic illustration of one embodiment of a device 1 for producing a textured coating on a substrate 3, in particular a spatially resolved, for example laterally spatially resolved production of a textured coating, for example a spatially resolved production of a location dependent, for example laterally location dependent textured coating, wherein the coating is obtained through the application of a fluid coating material, one which may be curable by way of particle radiation, in particular UV-radiation, wherein the device includes:

A device for transporting substrate 3 between the individual workstations is shown in FIG. 1. On device 1, the device the for transportation may include parts 21, 22 and 23 and a first roll 21 onto which a substrate or printing stock 3, consisting for example of paper, cardboard, laminated paper or laminated cardboard, plastic films or corrugated board substrates, or polyolefin film or PET or acetate film is wound.

Substrate 3 is moved in direction of arrow 25—the direction of travel—through device 1, wherein surface 31 of the printing stock or substrate 3 to be printed faces upward according to FIG. 1. Roll 22 is another part of the transport device.

Device 1 further includes a device 4, such as a coating unit 4, for application of the fluid coating material onto substrate 3. A device for applying fluid coating material is described for example as a coating unit in WO 2009/012996 whose disclosure content is incorporated herein and is thus made also subject of the current disclosure, wherein according to the current invention, the therein described device for smoothing the film that was applied onto the substrate surface by way of the coating unit can be used advantageously but represents an optional unit whose use is not imperative for implementation of the invention.

Device 4 can be designed in such a way that the fluid coating material is applied over the entire area of surface 31 of substrate 3 or only over a partial area of the same. An application over the entire area of surface 31 of substrate 3 is advantageous if a fluid coating material is applied which assumes a protective function in its hardened state, offering for example scratch resistance. On the other hand, a partial application—in other words an application of a fluid coating material over only a partial area of surface 31 of substrate 3—is advantageous in order to specifically highlight for example a certain sector of the substrate, for example in the form of images or texts.

Device 1 moreover includes a curing device 7 for curing the coating. Curing of the coating is performed in particular in two steps in a location dependent manner, for example in a laterally location dependent manner. The power introduced in a location dependent, in particular laterally location dependent manner by way of device 7 for curing of the coating can be adjustable in such a way that, in a first step only the surface layer of the coating is treated. The surface layer herein has a thickness of preferably between 10 nm and 1 μm. In a second step, the coating is curable over the entire thickness. Device 7 may include an informational device, such as a controller and/or software, to control curing. The information device is designed in particular to determine the power, dose and/or location of curing.

Generally, without limitation to the previously described example it is possible that the same or constant power is introduced over the entire area of the two-dimensional representation—for example in that curing occurs uniformly and without local variation of power and/or wavelength UV irradiation, for example by way of a UV medium pressure emitter. In this case it is moreover possible that merely due to the different thickness of the coating, different textures of coating form in a location dependent, for example laterally location dependent manner, in that for example in the regions having a greater layer thickness micro-folding occurs. However, in regions having a lower layer thickness a smooth surface is produced without micro-folding.

FIG. 1 also shows a dryer device 6 for drying the coating. By way of this device it is possible in a first step to remove volatile components of the coating material prior to curing. Such a device 6 is however only optionally included in device 1. Device 1 can also include a device 8 for cooling the coated substrate after curing.

FIG. 1 moreover illustrates a device 9, e.g. scanner 9, for scanning a two-dimensional representation. Device 9 for scanning a two-dimensional representation includes for example a sensor by way of which the color location of pixels of the two-dimensional representation is captured in a spatially resolved, in particular a laterally spatially resolved manner. Device 9 includes for example a color sensor, for example a sensor comprising a UV laser diode.

According to an additional embodiment, device 9 moreover includes a device to sense a height profile of a two-dimensional representation. This device that, according to this embodiment the color and texture relief information of the two-dimensional representation—for example in the embodiment of a painting—can be sensed and digitized by way of device 9, in other words for example by way of a scanner, for example a 3D scanner. Based on the thus obtained digitized data record—which includes the color information as well as the relief information for example in the form of a gray scale image of the two-dimensional representation—a coating can be applied, first of all based on evaluation of the color information and a color application based thereupon and then, in a subsequent step based on evaluation of the texture and relief information, so that the observer has the optic and haptic impression of an original painting. In this manner not only a texture can be produced but also a surface relief of a coating on a two-dimensional representation.

Device 1 includes furthermore an information device to store and/or evaluate a digitized data record of a two-dimensional representation in the embodiment of a computer. It is however also possible that the information device is integrated into device 9.

According to one embodiment of the present invention, device 1 can furthermore include a system control unit, for example in the embodiment of information device, for example a computer for controlling the process steps in the system, wherein said the device collects the relevant parameters in all process steps, for example by way of a sensor and controls them in each case with assigned actuators, thereby ensuring their interaction. It is moreover also possible that the information device for storing and/or evaluation of a digitized data record is comprised by system control unit 5, in other words—as presented here as an example—that device 9 is connected by way of an interphase 59 with device 5 as the information device for storing and evaluating of a digitized data record of a two-dimensional representation.

System control unit 5 may also include ways, such as a controller and/or software stored in a memory, to read out parameters in an informational format which is used for example widely in the printing industry, for example JDF (job definition format) and to convert them into process steps. Such ways can for example include a parameterization record that is filed on a memory device.

It is also possible that device 1, without limitation of the herein described design example comprises several system controls which in each case control individual devices in a targeted manner.

In accordance with an additional embodiment of the invention device 1 includes at least always at least one sensor and at least one encoder and actuators. The at least one sensor and at least one encoder are configured to collect the specific process steps by way of the sensor. The process steps are controlled by the computer implement by way of the corresponding actuators which are controlled by the system control unit 5.

According to one another embodiment, system control unit 5 is connected with devices, which are included in device 1, for example devices 4, 6, 7, 8, 9 via suitable interphases, for example interphases 54, 56, 57, 58, 59.

Figure 2:
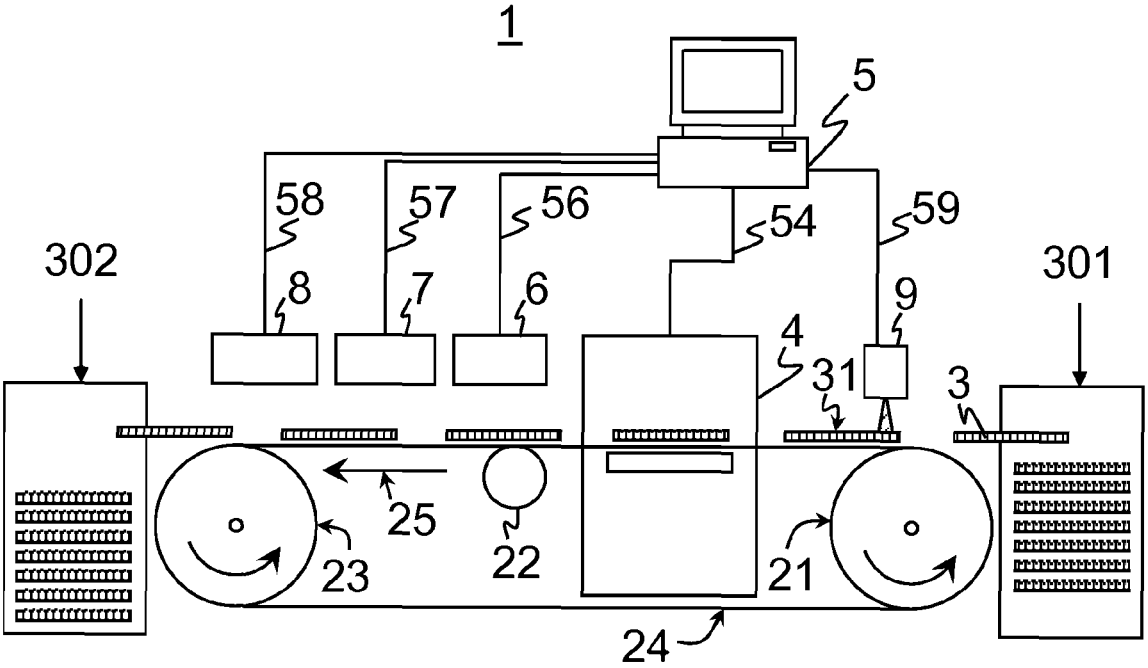
FIG. 2 is an additional schematic illustration of a device according to an additional embodiment.

FIG. 2 shows a further schematic representation of a device 1 according to an additional embodiment. Device 1 includes a substrate accommodating device 301 in which various substrates 3 are contained and which—for the sake of better clarity—are not all identified. From device 301 which serves to accommodate substrate 3, individual substrates 3 which may include for example paper, cardboard, laminated paper or laminated cardboard, plastic films and corrugated cardboard substrates or polyolefin film or PET or acetate film are moved between the individual process stations through device 1 by way of a transport device for substrate 3.

The device for transporting substrate 3 includes a first roller 21, a second roller 23 as well as additionally a roller 22, wherein also various additional rollers 22 can be comprised by the device for transport. The transport device further includes a transport belt 24 which combines the two rollers 21 and 23 with each other through which rotation of at least one roller 21, 23 causes a movement of substrates 3 through device 1 in the direction of arrow 25.

Device 1 includes a device 4 for application of the fluid coating material onto substrate 3, as well as a device 7 for curing coating.

Also shown are devices 6 and 8 which can aid in drying the fluid coating material or respectively the cooling of the printed substrate after curing and which are only optional in the present application. Devices 4, 6, 7, 8, 9 can respectively be connected via an interphase 54, 56, 57, 58, 59 with a system control unit 5. Such a system control unit 5 with the corresponding interphases is also only optionally included in device 5.

FIG. 2 also shows a device 9 for scanning of a two-dimensional representation. Device 9 for scanning a two-dimension representation includes for example a sensor by way of which preferably spatially resolved the color location of pixels of the two-dimensional representation is sensed. Device 9 includes for example a color sensor, for example a sensor comprising a UV laser diode. According to an additional embodiment, device 9 includes ways for capturing a height profile of a two-dimensional representation. The device 9 moreover comprises an information device for storing and/or evaluating a digitized data record of a two-dimensional representation. The information device can for example be a computer. It is possible that the computer is a separate item. It is however also possible that the information device is part of a system control unit 5 or is comprised by the same.

Moreover, it generally possible without limitation to the herein described design example that several system control units 5 are comprised by a device 1 which respectively control individual devices 4, 6, 7, 8 and 9.

Device 1 moreover includes a removal device 302 for removal of substrate 3.

Figure 3:
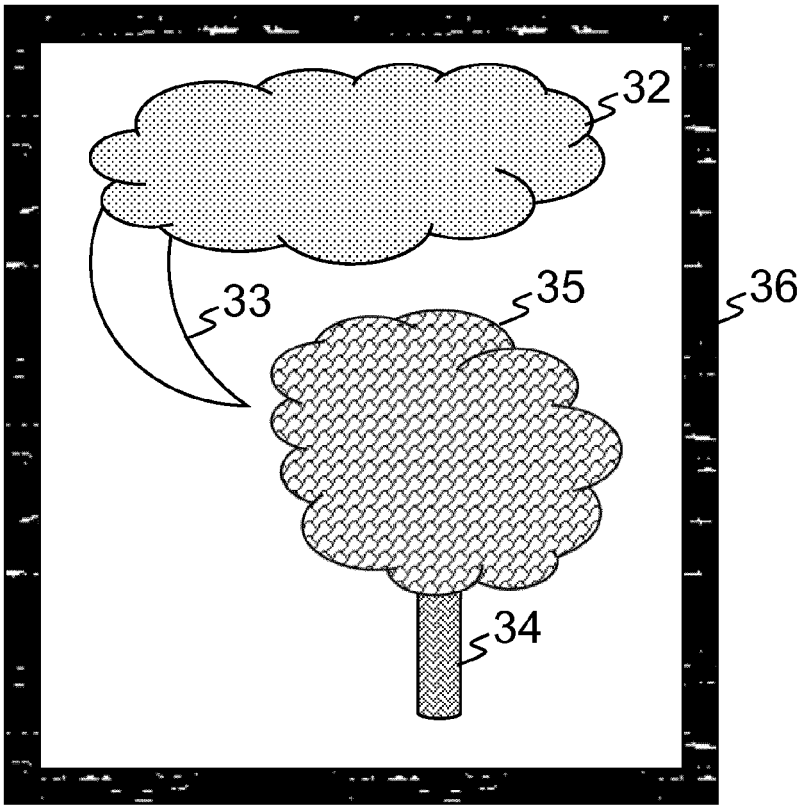
FIG. 3 is a schematic illustration of a two-dimensional representation with laterally spatially resolved different textures.

FIG. 3 is a schematic illustration of a two-dimensional representation. The two-dimensional representation is applied onto a substrate 3 (not illustrated) and comprises several regions 32, 33, 34, 35, 36 which have different structures. Region 32 for example is depicted as a cloud.

The character of the structure is generally viewed to be matt, so that in this region 32 rather a matt coating texture is to be produced. Region 33 is a schematic illustration of a moon and therefore receives a glossy surface texture in order to produce a highly glossy surface which supports the visual impression of the moon as a glowing celestial phenomenon. Region 34 is illustrated as a tree trunk and region 35 as a tree top. Both regions show characteristic structures: tree top 35 for example in the form of foliage and tree trunk 34 in the form of bark. The relevant textures can be produced according to the process, so that the visual impression of the two-dimensional representation can be even more clearly emphasized by applying a textured coating, in particular lacquering in a spatially resolved, in this case laterally spatially resolved and location dependent, in this case laterally location dependent manner. Region 36 of the two-dimensional representation is a depiction of a wooden frame so that in this region 36 the texture of a rough grainy wood surface is produced.

Naturally, in this manner not only aesthetic effects are possible. It is also possible to produce haptic impressions in a targeted manner.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method to produce a textured coating, comprising:

providing a two-dimension representation in the form of an image, wherein the image is at least one of a photographic image and/or digitized in the form of a data record, a system control unit, a coating unit configured for applying a coating, and an irradiation device;

evaluating, by the system control unit, the two-dimensional representation, wherein evaluation by the system control unit includes a spatially resolved determination of a color shade, a brightness, a saturation, a contrast, and/or at least one spatial frequency comprising a spatial frequency of the color shade, the saturation, the brightness, and/or the contrast;

determining, by the system control unit, local structures of the two-dimensional representation based thereupon;

determining a type and a location of at least one texture that is to be produced on at least one region of the two-dimensional representation, by the system control unit, so that in addition to color information of the two-dimensional representation, a surface texture and/or a surface relief and/or a height profile of the two-dimensional representation are recorded and converted into texture information which is transferred by the coating unit;

applying the coating, by the coating unit, to the at least one region of the two-dimensional representation, wherein the coating is applied in a laterally location dependent manner in such a way that a thickness of the coating and/or a post-treatment of the coating and/or a pre-treatment of the at least one region which is to be coated is specifically adapted to a type of the at least one texture of the coating to be produced which is in the form of a surface layer of the coating;

curing the applied coating, wherein curing depends upon a location, a duration of curing, and/or a type of curing in different regions of an applied coating and/or in different partial regions of the two-dimensional representation of an applied coating, and curing is always adapted to the type of the texture of the coating, wherein the surface layer of the coating is treated in a laterally location dependent manner, wherein the surface layer of the coating has a thickness of between 10 nm and 1 μm, wherein the coating comprises an ultraviolet (UV) curing coating, wherein the coating comprises a synergist and a Type I photo initiator and a Type II photo initiator, so that a reactivity on the surface layer of the applied coating specifically differs from a reactivity in a volume of the applied coating; and irradiating the coating, by the irradiation device, with UV-C irradiation having a wavelength of more than 240 nm being introduced into at least one region to be textured in the surface layer of the coating, and the irradiating occurs in a location dependent two-step manner in that, in one irradiated section of the coating that was applied onto the at least one region of the two-dimensional representation a smaller UV dose which produces micro-folding is administered in a first step and in a second step, a surface layer of the coating in the irradiated section is completely cured, wherein for curing longer wave UV irradiation is used than that of a UV medium pressure emitter, so that in the irradiated section of the coating a predefined texture of the surface layer of the coating is obtained which deviates from the texture or textures of the surface layer in other sections of the coating or in other sections of the coating applied to the two-dimensional representation.

2. The method according to claim 1, wherein the at least one texture produced through the system control unit is changeable.

3. The method according to claim 1, wherein at least one texture in the at least one region of the two-dimensional representation has a visual and/or a haptic impression which differs from a visual and/or a haptic impression in another region of the two-dimensional representation.

4. The method according to claim 1, wherein the two-dimensional representation is in the embodiment of a picture file, and the method further including a step of providing a substrate with a surface, and the substrate includes the two-dimensional representation on its surface.

5. The method according to claim 4, further including a step of applying the two-dimensional representation onto the surface of the substrate or into the surface of the substrate.

6. The method according to claim 1, wherein a plurality of same two-dimensional representations are successively covered with a respective coating in a spatially resolved manner, and wherein a first two-dimensional representation of the plurality of same two-dimensional representations is scanned, and based on an evaluation of the data record which is obtained by a scan of the first two-dimensional representation, an application of the respective coating occurs onto a texturing of a coating of a successive two-dimensional representation of the plurality of same two-dimensional representations.

7. The method according to claim 6, further including a step of scanning, by a UV laser diode sensor, the two-dimensional representation or the plurality of same two-dimensional representations.

8. The method according to claim 7, further including a step of converting color values from a color system of a three-color space into another color system.

9. The method according to claim 7, wherein during the scanning step, a pixel size is determined, and the step of applying the coating incorporates the pixel size and/or the pixel size is retained or improved in a location dependent creation of the at least one texture of the coating.

10. The method according to claim 1, wherein the thickness of the applied coating is differently laterally spatially resolved and curing occurs in such a way that across an entire surface of the two-dimensional representation a mercury medium pressure emitter introduces a constant power into the coating.

11. The method according to claim 1, wherein the irradiation device is a mercury medium pressure emitter configured for conducting the irradiation of the surface layer and irradiation for curing the coating.

12. The method according to claim 1, wherein the step of irradiating includes UV irradiation in a nitrogen atmosphere.

13. The method according to claim 1, wherein a location dependent irradiation of the surface layer for micro-folding occurs in at least one section by spatially resolved scanning of the coating surface.

14. The method according to claim 13, wherein the step of scanning includes screening, in that the surface is scanned line-by-line, and each line is moreover divided into individual image points or pixels and each line respectively is assigned to a forward move of a scanner head of a scanner.

15. The method according to claim 14, wherein a residual oxygen content is less than 5000 ppm.

16. The method according to claim 1, wherein the step of applying the coating includes a printing process, comprising a gravure printing, a flexo printing, a screen printing, a pad printing, or an inkjet printing process.

* * * * *